US009869177B2

(12) United States Patent
Meline

(10) Patent No.: US 9,869,177 B2
(45) Date of Patent: Jan. 16, 2018

(54) DEVICE FOR ANCHORING IN MULTILAYER SOIL

(75) Inventor: Christian Meline, Scy Chazelles (FR)

(73) Assignee: SOCIETE INDUSTRIELLE DE PRODUITS MECANIQUES ANCR'EST, Saint-Avold (FR)

( * ) Notice: Subject to any disclaimer, the term of this patent is extended or adjusted under 35 U.S.C. 154(b) by 760 days.

(21) Appl. No.: 13/516,711

(22) PCT Filed: Sep. 28, 2010

(86) PCT No.: PCT/FR2010/052031

§ 371 (c)(1),
(2), (4) Date: Aug. 20, 2014

(87) PCT Pub. No.: WO2011/073545

PCT Pub. Date: Jun. 23, 2011

(65) Prior Publication Data

US 2015/0128509 A1 May 14, 2015

(30) Foreign Application Priority Data

Dec. 16, 2009 (WO) ..... PCT/FR2009/052578

(51) Int. Cl.
*E02D 27/50* (2006.01)
*E21D 20/02* (2006.01)
(Continued)

(52) U.S. Cl.
CPC ..... *E21D 20/028* (2013.01); *E02D 1/02* (2013.01); *E02D 5/801* (2013.01); *E02D 5/808* (2013.01);
(Continued)

(58) Field of Classification Search
CPC .. E02D 5/74; E02D 5/80; E02D 5/801; E02D 5/30; E02D 2/28
(Continued)

(56) References Cited

U.S. PATENT DOCUMENTS 2,603,319 A * 7/1952 Dyche ..... E02D 5/801 175/394
3,494,133 A * 2/1970 Leidvik ..... E02D 5/76 175/65
(Continued)

FOREIGN PATENT DOCUMENTS

| | | |
|---|---|---|
| DE | 3400182 A1 | 7/1985 |
| DE | 4201419 C1 | 8/1993 |
| FR | 2863633 A | 6/2005 |

OTHER PUBLICATIONS

An International Search Report, dated Jan. 3, 2011, which issued during the prosecution of International Application No. PCT/FR2010/052031, which corresponds to the present application.

*Primary Examiner* — Beth Stephan
(74) *Attorney, Agent, or Firm* — Blank Rome LLP

(57) ABSTRACT

The invention relates to an anchoring device wherein a positioning plate (5), intended for bearing on the ground surface, is mounted onto a hollow rod (2). The rod consecutively supports, from the positioning plate (5) to the free end (22), at least one helical force disk (6) then one helical penetration disk (8). Said anchoring device is characterized in that the rod extends after the helical penetration disk opposite the plate (5). Said anchoring device is moreover characterized in that a bit (4) is placed on the free end of said rod so that a first portion of the rod (2), capable of being screwed into at least one first ground layer, extends from the plate (5) to the helical penetration disk and moreover so that a second portion of the rod (2), capable of being anchored in a second ground layer, extends from the helical penetration disk (8) to the bit (4).

12 Claims, 9 Drawing Sheets

(51) Int. Cl.

| | |
|---|---|
| ***E02D 5/80*** | (2006.01) |
| ***E02D 1/02*** | (2006.01) |
| ***E02D 7/22*** | (2006.01) |
| ***E21D 20/00*** | (2006.01) |

(52) U.S. Cl.
CPC ..... *E02D 7/22* (2013.01); *E02D 27/50* (2013.01); *E21D 20/003* (2013.01); *E21D 20/021* (2013.01); *E21D 20/025* (2013.01)

(58) Field of Classification Search
USPC ..... 52/153–157, 295–298, 169.13, 103; 405/224, 230, 252.1, 259.1, 172; 173/91, 173/213; 175/19, 170; 114/230.1, 230.2, 114/230.3, 230.23; 119/791
See application file for complete search history.

(56) References Cited

U.S. PATENT DOCUMENTS

| | | | | |
|---|---|---|---|---|
| 5,066,168 | A * | 11/1991 | Holdeman | 405/249 |
| 5,482,407 | A * | 1/1996 | Raaf | 405/230 |
| 5,707,180 | A * | 1/1998 | Vickars et al. | 405/233 |
| 5,732,659 | A * | 3/1998 | Wiggins | 119/787 |
| 5,740,684 | A | 4/1998 | Sherlock et al. | |
| 5,919,005 | A * | 7/1999 | Rupiper | 405/244 |
| 5,934,836 | A * | 8/1999 | Rupiper et al. | 405/244 |
| 6,193,443 | B1 * | 2/2001 | Trudeau et al. | 405/252 |
| 6,641,332 | B1 * | 11/2003 | Alvarado | 405/232 |
| 6,652,195 | B2 * | 11/2003 | Vickars et al. | 405/239 |
| 6,722,821 | B1 * | 4/2004 | Perko et al. | 405/249 |
| 6,814,525 | B1 * | 11/2004 | Whitsett | E02D 5/38 405/233 |
| 6,820,573 | B1 * | 11/2004 | McMullin | 119/791 |
| 6,963,026 | B2 * | 11/2005 | Brennan | 174/7 |
| 7,416,367 | B2 * | 8/2008 | St. Onge et al. | 405/230 |
| 7,494,299 | B1 * | 2/2009 | Whitsett | E02D 5/38 405/251 |
| 7,635,240 | B2 * | 12/2009 | Gantt, Jr. | E02D 5/80 405/252.1 |
| 7,887,263 | B2 * | 2/2011 | Moffat | 405/259.1 |
| 8,033,757 | B2 * | 10/2011 | Stroyer | 405/233 |
| 8,845,236 | B1 * | 9/2014 | Dosdourian | E02D 5/801 175/19 |
| 2001/0039913 | A1 * | 11/2001 | Truax | 116/209 |
| 2003/0147704 | A1 * | 8/2003 | Parker | 405/259.1 |
| 2006/0013656 | A1 * | 1/2006 | Blum | 405/241 |
| 2007/0286687 | A1 | 12/2007 | Melegari | |
| 2008/0157521 | A1 * | 7/2008 | Davis | 285/331 |
| 2009/0116910 | A1 * | 5/2009 | Whitsett | E02D 5/38 405/232 |
| 2009/0180838 | A1 * | 7/2009 | Ronnkvist | E02D 5/801 405/251 |
| 2010/0054864 | A1 * | 3/2010 | Stroyer | 405/233 |
| 2010/0300017 | A1 * | 12/2010 | Bulloch | 52/157 |
| 2012/0001037 | A1 * | 1/2012 | Ronnkvist | 248/156 |
| 2012/0036797 | A1 * | 2/2012 | Ardern | E04H 12/2223 52/157 |
| 2014/0286712 | A1 * | 9/2014 | Lutenegger | E02D 5/56 405/252.1 |

* cited by examiner

DEVICE FOR ANCHORING IN MULTILAYER SOIL

CROSS REFERENCE TO RELATED APPLICATIONS

This application is a U.S. National Phase application under 35 U.S.C. §371 of International Application No. PCT/FR2010/052031, filed on Sep. 28, 2010, and claims priority to PCT/FR2009/052570, filed Dec. 16, 2009; which claims priority to FR 0950051, filed Jan. 6, 2009. The contents of these applications are herein incorporated by reference.

TECHNICAL FIELD

The present invention relates to a device for anchoring in multilayer soil, of the type having a hollow rod whereof a first end receives a fastening means and whereof the opposite free end is intended to drill into the soil.

BACKGROUND

Two types of anchoring devices are known, each adapted to anchor in specific soils. The anchoring, whether on land or water, of buildings or structures can in fact be performed on loose soils or harder soils. Screw anchoring devices, having one or more attached helical discs welded on a rod, are therefore provided for loose soils. These screw anchors can thereby stabilize the structure to be anchored, once the first loose soil layer is thick enough.

Aside from this first problem related to the environment in which this type of device must be used, another drawback is that this type of screw anchoring device cannot be used in layers of hard soils. Self-drilling anchoring devices are provided in the case of these hard soils, in which devices the rod is provided at its end with a bit able to dig into the soil and whereof the dimension larger than the diameter of the rod makes it possible to create a cavity in which cement is injected to secure the anchoring with the ground. Such a self-drilling device does, however, have the drawback of not adapting to softer soils.

However, the anchoring structure can be made in a soil with varying hardness, formed from the surface by a first layer of loose soil, then a second monolithic layer. The use of one or the other of the devices mentioned above does not allow satisfactory anchoring of the structure. The first layer of loose soil has too small a thickness to stabilize a screw anchoring device, and the use of self-drilling anchoring is made impossible by the depth to which the second layer extends, the distance to the surface risking destabilizing the self-drilling anchoring.

Furthermore, the self-drilling capability of the anchoring devices used to date may be insufficient, in particular in certain underwater grounds of varied granulometry and mineral structure, compacted by water pressure, as well as certain ground on land consisting of clay and limestone or hydraulically compressed ground with a density similar to that of monolithic ground.

SUMMARY OF THE DISCLOSURE

The present invention aims to propose an anchoring device that allows solid anchoring in soils with variable thicknesses and/or different hardnesses, as mentioned above.

To that end, the invention proposes a device for anchoring in multilayer soil. The anchoring device is of the type having a hollow rod whereof a first end receives a fastening means and whereof the free opposite end is intended to drill into the ground, in which a positioning plate is mounted on the hollow rod and is intended to bear on the surface of the soil. The rod successively supporting, from the positioning plate towards the free end, at least one helical force disc then a helical drilling disc, characterized in that the rod extends beyond the helical drilling disc opposite the positioning plate, and in that a bit is arranged on the free end of said rod, such that a first portion of the rod, suitable for being screwed into at least one first soil layer, extends from the positioning plate to the drilling disc, and such that a second portion of the rod, suitable for anchoring in a second soil layer, extends from the helical drilling disc to the bit.

Such a device allows resistant structure anchoring, the first part of the rod being intended to be screwed into a first soil layer, for example loose, which extends over a second layer of soil, for example monolithic and consolidated of the rocky type, harder than the first soil layer, and in which the second part of the rod is suitable for being anchored.

According to different features of the present invention:

- the bit has a diameter larger than the diameter of the rod;
- the at least one helical force disc and the helical drilling disc are welded on the rod;
- a cylindrical casing is formed around the first part of the rod, between the positioning plate and the helical force disc closest to the plate;
- a cylindrical casing is formed around the first part of the rod, between the positioning plate and the helical drilling disc,
- the cylindrical casing has a variable diameter whereof the smallest diameter is larger than the diameter of the second part of the rod,
- the cylindrical casing has a first section extending from the positioning plate and having a first diameter followed by a second section extending to the helical drilling disc and having a second diameter smaller than the first diameter and larger than the diameter of the second part of the rod,
- the hollow rod is threaded or smooth,
- the hollow rod is threaded over at least the second part extending between the helical drilling disc and the bit, and in that this hollow rod is smooth in the first part surrounded by the cylindrical casing;
- at least part of the rod and the bit are pierced with holes for injecting a cement or a synthetic resin for anchoring in compact rocky-type soils;
- the holes for injecting cement are pierced only on the second part of the rod and on the bit,
- the holes for injecting cement or resin are pierced over the first part and the second part of the rod and on the bit,
- the at least one helical force disc has an external diameter greater than the external diameter of the helical drilling disc,
- the hollow rod has, between the at least one helical force disc and the helical drilling disc, at least one intermediate helical disc having an external diameter between the external diameters of the helical stress and penetration discs, respectively,
- the at least one helical intermediate disc is formed by an interrupted spiral, and
- the at least one helical intermediate disc is formed by a continuous conical spiral connecting the helical discs.

BRIEF DESCRIPTION OF THE DRAWINGS

The invention will now be described in greater detail, but without limitation, based on the figures attached hereto, in which.

DETAILED DESCRIPTION OF THE DISCLOSURE

The anchoring device disclosed by the invention, as represented in all of the figures, includes a hollow rod 2, having a first end 21 that receives fastening means (not shown) of a structure or building to be anchored in the soil, the free opposite end 22 of the hollow rod 2 to that end being intended to drill into the soil. This structure is made to be fastened relative to the ground, whether in a land or water application.

Figure 1:
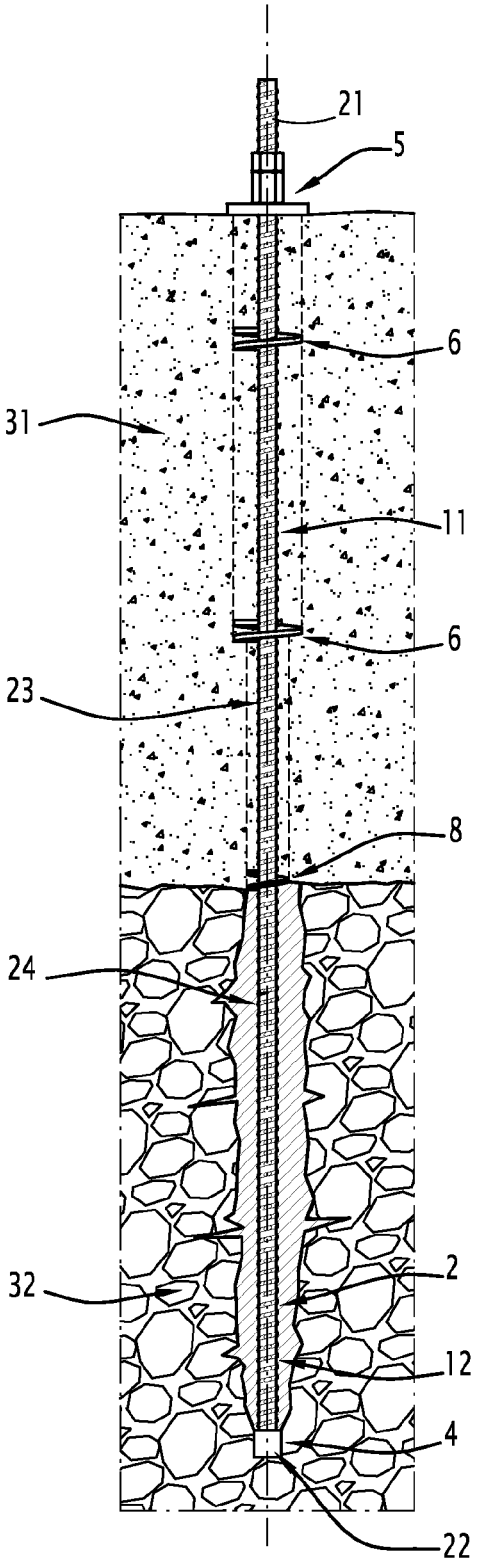
FIG. 1 is a diagrammatic illustration of an anchoring device according to a first embodiment of the invention.
Figure 2:
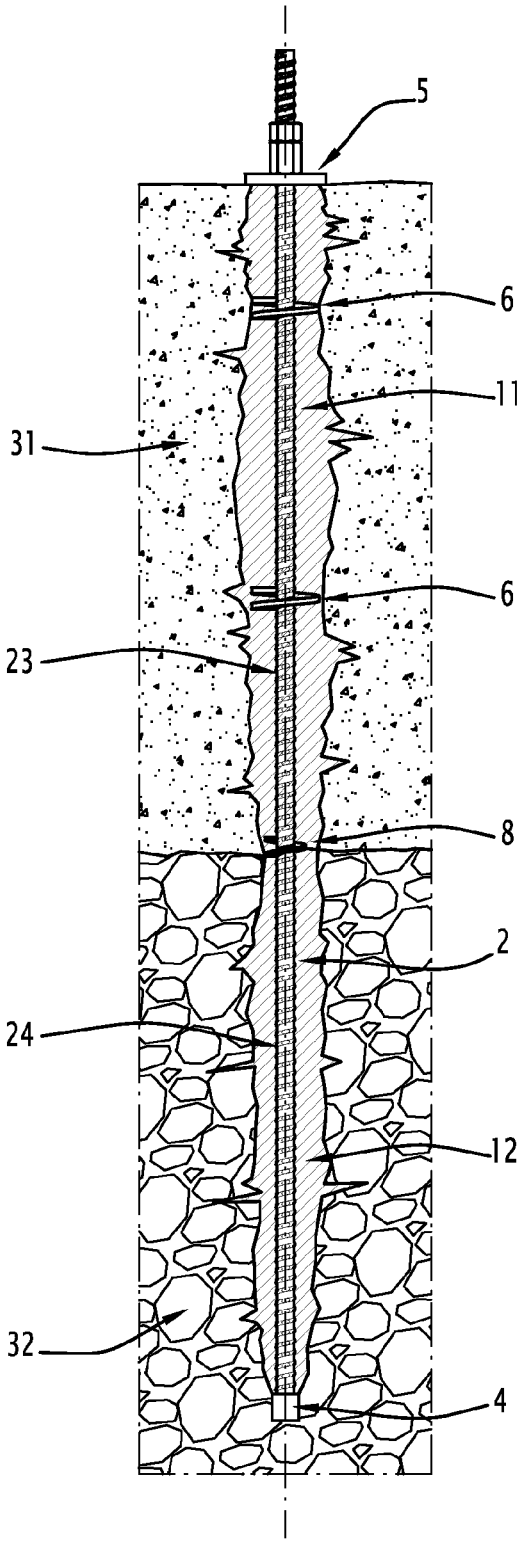
FIG. 2 is a diagrammatic illustration of an anchoring device according to a second embodiment of the invention.
Figure 3:
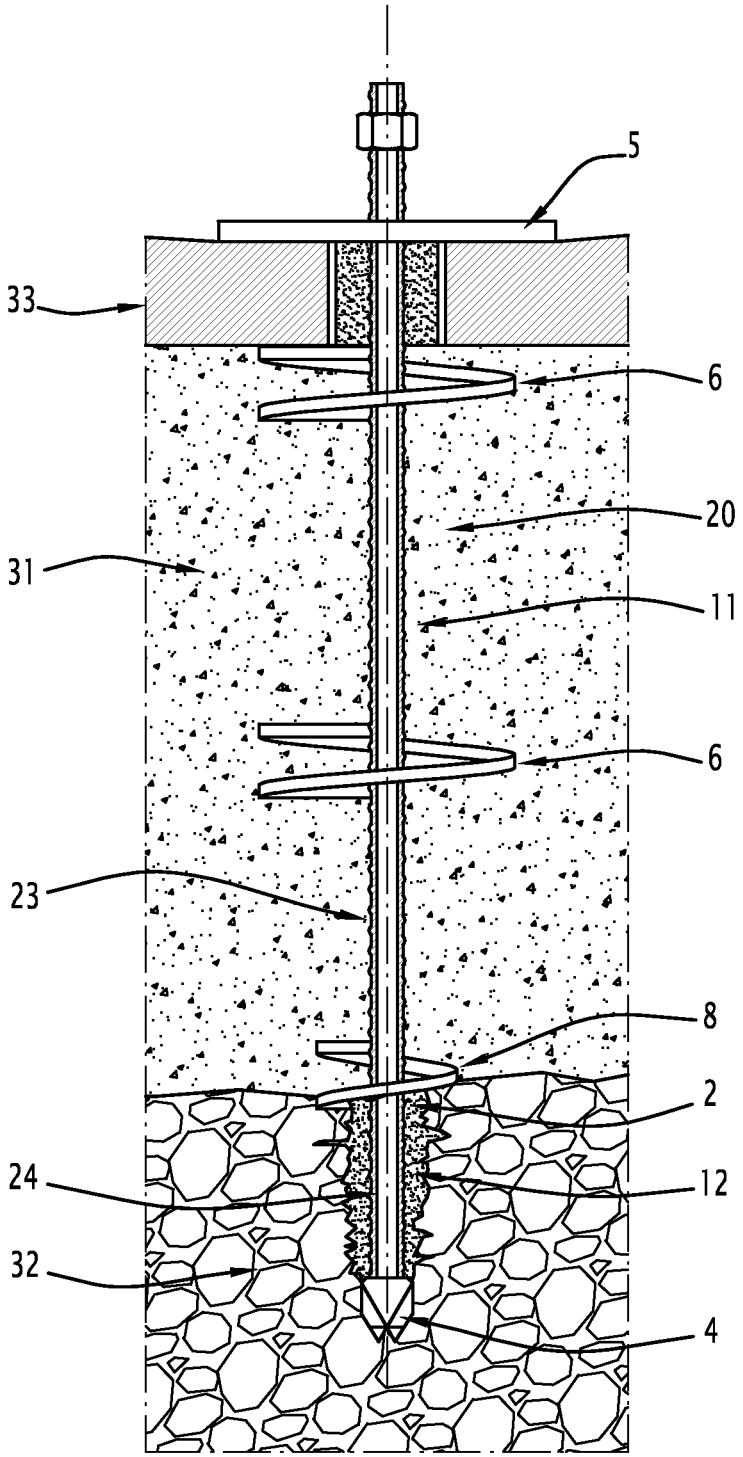
FIG. 3 is a diagrammatic illustration of an anchoring device according to a third embodiment of the invention.
Figure 4:
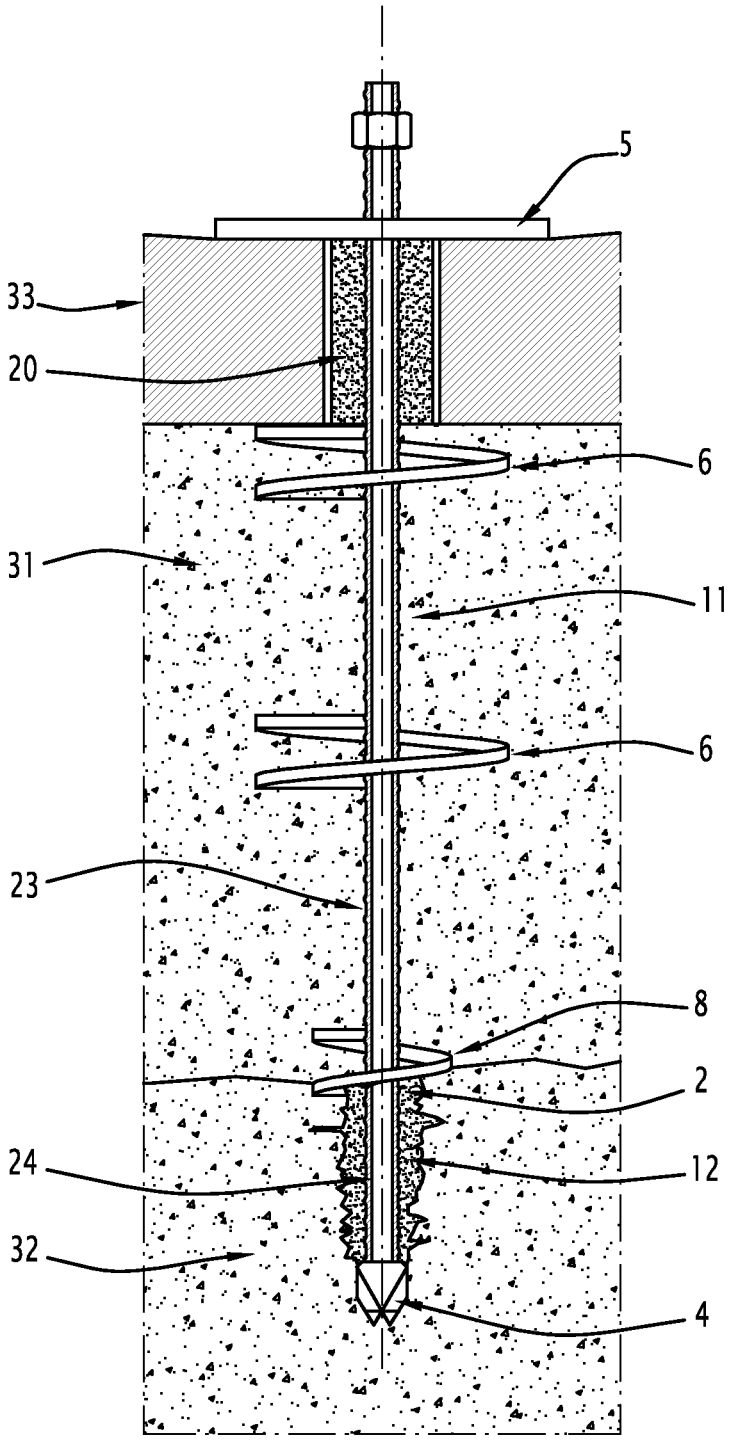
FIG. 4 is a diagrammatic illustration of an anchoring device according to a fourth embodiment of the invention.

This anchoring device is particularly interesting in the case of an anchoring soil made up of several layers with distinct compositions, and in particular a soil as illustrated in FIGS. 1 and 2, in which a first layer 31 is formed with a thickness of loose material, for example sand, gravel and generally non-consolidated materials, this first layer 31 resting on a second layer 32 made up of rocks, limestone or hardened concrete, and generally monolithic or consolidated materials, or in the case of a soil shown in FIGS. 3 and 4, in which a third layer 33, formed by silts, rests on this first layer 31.

To that end, the rod 2 has, at a predetermined distance from the ends, a helical drilling disc 8, a first part 23 of the rod 2 extending between the first fastening end 21 and this helical drilling disc 8, while a second part 24 of the rod 2 extends between the helical drilling disc 8 and the free drilling end 22. The first part 23 of the rod 2 is, as shown in the figures, suitable for being screwed into at least the first soil layer 31, and the second part 24 of the rod 2 is suitable for being anchored, by drilling of the end of the rod 2, into the second soil layer 32.

A positioning plate 5 is mounted on the hollow rod 2 and is intended to bear on the surface of the soil, while the helical drilling disc 8 is arranged on the rod 2 at a predetermined length from this positioning plate 5 so the helical drilling disc 8 rests on the upper part of the second layer of harder soil 32. An analysis of the soils before drilling makes it possible to determine the dimension of the first soil layer 31, and therefore to determine the distance from the positioning plate 5 at which the helical drilling disc 8 must be arranged on the rod 2.

Depending on the application and the type of terrain on which the anchoring device is used, the positioning plate 5 is not necessary, for example, for anchoring in underwater soil.

The first part 23 of the rod 2 has at least one helical force disc 6 whereof the function is to penetrate the first loose soil layer 31 by screwing. Depending on the thickness of the loose soil layer, several helical force discs 6 may be provided. The number of helical discs to be provided on the rod 2 depends on the density of the soil in which the rod must be anchored. Increasing the number of helical force discs makes it possible to increase the anchoring force of the device. Therefore, the lower the soil density, the higher the number of discs must be. The diameter of the chosen discs is determined to prevent excessive force collection torques. The distance between two helical force discs 6 depends on the diameter of the discs. This distance between two discs is between two and five times the diameter of the disc, and advantageously between three and four times this diameter.

The helical force discs 6 extend over the first part 23 of the rod 2, between the helical drilling disc 8 and the positioning plate 5. For the helical force discs to be engaged with the first soil layer 31, the diameter of the helical drilling disc 8, made to penetrate the soil before the helical force discs 6, must be equal to or smaller than the diameters of the helical force discs 6. All of the figures show helical force discs 6 with diameters equivalent to each other, and it will be understood that in accordance with what has been described above, the diameters of each helical disc 6 may vary, once a decrease in the diameter of the helical force discs 6 is respected, from the closest helical force disc 6 of the positioning plate 5 towards the closest helical force disc 6 of the helical drilling disc 8. These helical force discs 6 can advantageously have an entering leading bevel part, and reinforced by a filler metal. Like the hollow rod 2, these helical force discs 6 and drilling discs 8 can be made from high strength steel. The helical force discs and drilling discs 8 are welded on the rod 2.

According to one feature of the present invention, the rod 2 extends in a second part 24, after the helical drilling disc 8 opposite the positioning plate 5. A bit 4 is arranged at the free end 22 of this rod 2. This self-drilling bit 4 is welded or screwed on the end of the rod 2, and has the necessary rigidity characteristics to be able to drill into a second soil layer 32, made up of consolidated or monolithic material. The second part 24 of the rod 2 will thus participate in fastening the structure by anchoring in the soil, following the drilling done by the bit 4. The length of the second part 24 of the rod 2 is then chosen to perform this anchoring over a sufficient length to stabilize the anchoring device. According to one embodiment that is not shown, a connecting sleeve can be used to increase the total length of the rod and therefore the drilling depth in the soil.

Such a device allows resistant structure anchoring, the first part 23 of the rod 2 being intended to be screwed into at least one first loose soil layer 31, which extends over a second layer 32 of a monolithic and consolidated soil, harder than the first soil layer 31, and in which the second part 24 of the rod 2 is suitable for anchoring. The drilling end of the rod, provided with the bit, initially digs out the first loose soil layer, and forms a drilling hole that facilitates the screwing action of the helical drilling, then force discs in this first layer.

The bit 4 arranged at the free end of the rod 2 has a diameter larger than the diameter of the second part 24 of this rod 2. The drilling of the soil by the bit 4 then creates a cavity 12 in which the second part 24 of the rod 2 extends after the bit 4. In order to anchor the rod 2 in the soil, cement or synthetic resin is injected into this cavity 12 (FIGS. 1-5) to keep the rod 2 in position relative to at least the second soil layer 32. To that end, at least part of the rod 2 and the bit 4 are pierced with holes, not shown, for the injection.

This cement or resin can be injected over a more or less large part of the rod 2 of the anchoring device. In a first embodiment shown in FIG. 1, only the second part 24 of the rod 2 and the bit 4 are pierced with injection holes.

In a second embodiment shown in FIG. 2, the assembly of the rod 2 and the bit 4 are pierced with injection holes, so that the cement or resin spreads around the entire rod 2, in the cavity 12 formed by the bit 4 for the second part 24 of the rod 2, and into an additional cavity 11 formed by the helical drilling disc 8 and the helical force discs 6 for the first part 23 of the rod 2.

The choice of using an anchoring device according to either of the embodiments mentioned above is in particular made by the thicknesses of the different layers of each soil. If the first soil layer 31 and the third soil layer 33 require that the first part 23 of the rod 2 be large, it may be deemed preferable for the stability of the anchoring to inject cement over the entire rod 2.

However, the composition of the third soil layer 33, made up of silts, makes it impossible to inject cement or resin around the first part 23 of the rod 2, which extends in this third layer. The additional cavity 11 formed by the passage of the helical drilling disc 8 in the third soil layer 33 is immediately plugged back up after the passage of the helical drilling disc 8. This can also be the case in the first soil layer 31, in particular if this layer is made up of sand.

In order to form a space in which the injected resin or cement can be inserted, as illustrated by FIGS. 3 and 4, a cylindrical casing 20 is formed around the first part 23 of the rod 2. The casing 20 extends between the positioning plate 5 and the helical force disc 6 closest to this plate, and rests against the plate 5 and this disc. Therefore, after the passage of the discs, the loose material making up the third soil layer 33 cannot plug up the additional cavity 11 formed by the discs 6, and 8, and cement can be injected between the rod 2 and the cylindrical casing 20. It should be noted that, in one embodiment that is not shown, the casing can be provided between two helical force discs 6 to allow cement to be injected around the rod in the first soil thickness 31.

According to one alternative, the cylindrical casing 20 is formed around the first part 23 of the rod 2, between the positioning plate 5 and the helical drilling disc 8.

Figure 5:
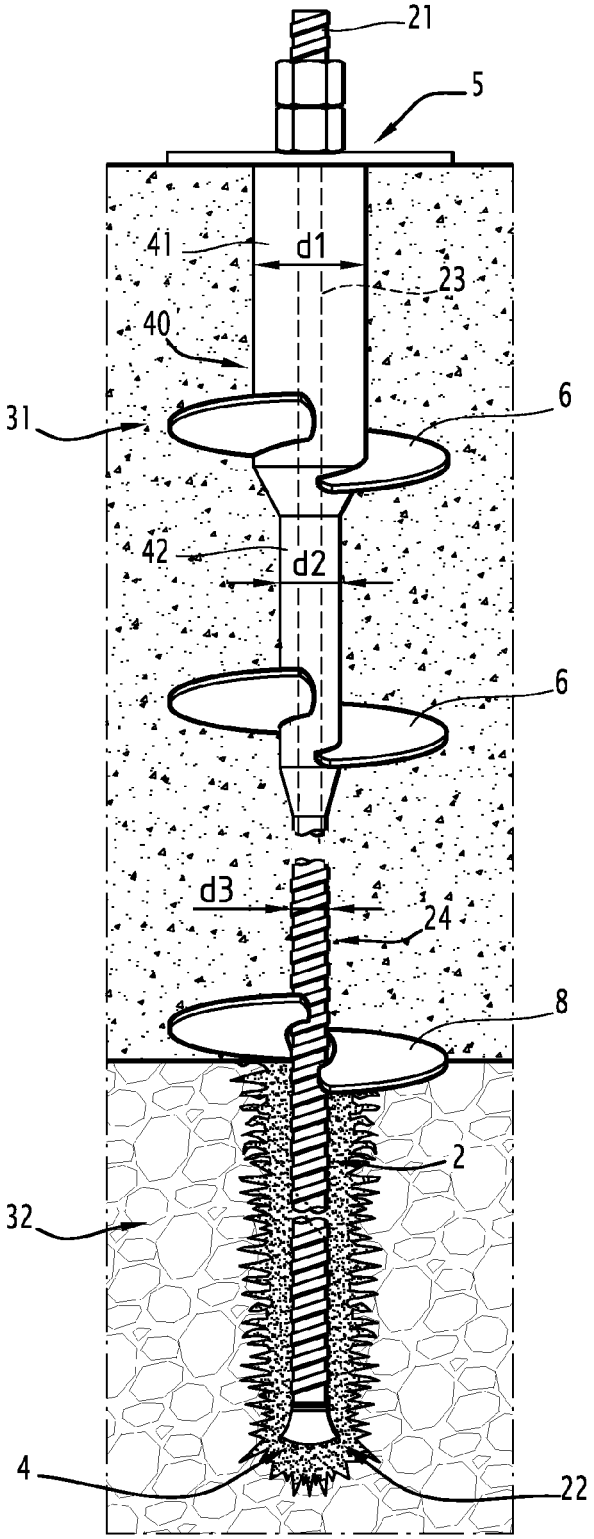
FIG. 5 is a diagrammatic illustration of an anchoring device according to a fifth embodiment of the invention.

In a fifth embodiment shown in FIG. 5, a cylindrical casing 40 is formed around the first part 23 of the rod 2 between the positioning plate 5 and the helical drilling disc 8 and this casing 40 has a variable diameter.

In general, the variable diameter of the cylindrical casing 40 varies between a large diameter and a small diameter that is larger than the diameter of the second part 24 of the rod 2.

As shown in FIG. 5, the cylindrical casing 40 has a first section 41 extending from the positioning plate 5 and having a first diameter d1 followed by a second section 42 extending up to the helical drilling disc 8 and having a second diameter d2 smaller than the first diameter d1 and larger than the diameter d3 of the second part 24 of the rod 2.

In this embodiment as well, at least part of the rod 2 and the bit 4 are pierced with holes for injecting cement or a synthetic resin.

Therefore, according to different embodiments, only the part of the rod 2 situated between the helical drilling disc 8 and the bit 4 is pierced with holes for injecting cement or resin or only the part of the rod 2 situated between the last helical force disc 6 and the helical drilling disc 8 is pierced with holes for injecting cement or a synthetic resin.

According to still another embodiment, the holes for injecting cement or synthetic resin are pierced over the entire length of the second part 24 of the rod 2 and on the bit 4.

As shown in FIG. 5, holes are also pierced on the first part 23 of the rod 2 for filling chambers inside the casing 40 with cement or synthetic resin. This filling increases the strength of the casing and also makes it possible to eliminate any internal corrosion.

The sections 41 and 42 of the cylindrical casing 40 are welded to each other and they support helical force discs 6. The threaded or smooth hollow rod 23 forms the main strength column and allows all types of attachments in the upper part as well as the connections with a cement or synthetic resin injection device.

Moving to FIGS. 6-9, other embodiments of the anchoring device disclosed by the invention will be described.

In these figures, the elements common to the foregoing embodiments are designated with the same reference numbers.

The anchoring device shown in these figures has a self-drilling capability greater than that of the devices described above, and may be used, in particular in certain underwater grounds of varied granulometry and mineral structure, compacted by water pressure, as well as certain ground on land consisting of clay and limestone or hydraulically compressed ground with a density similar to that of monolithic ground.

Figure 6:
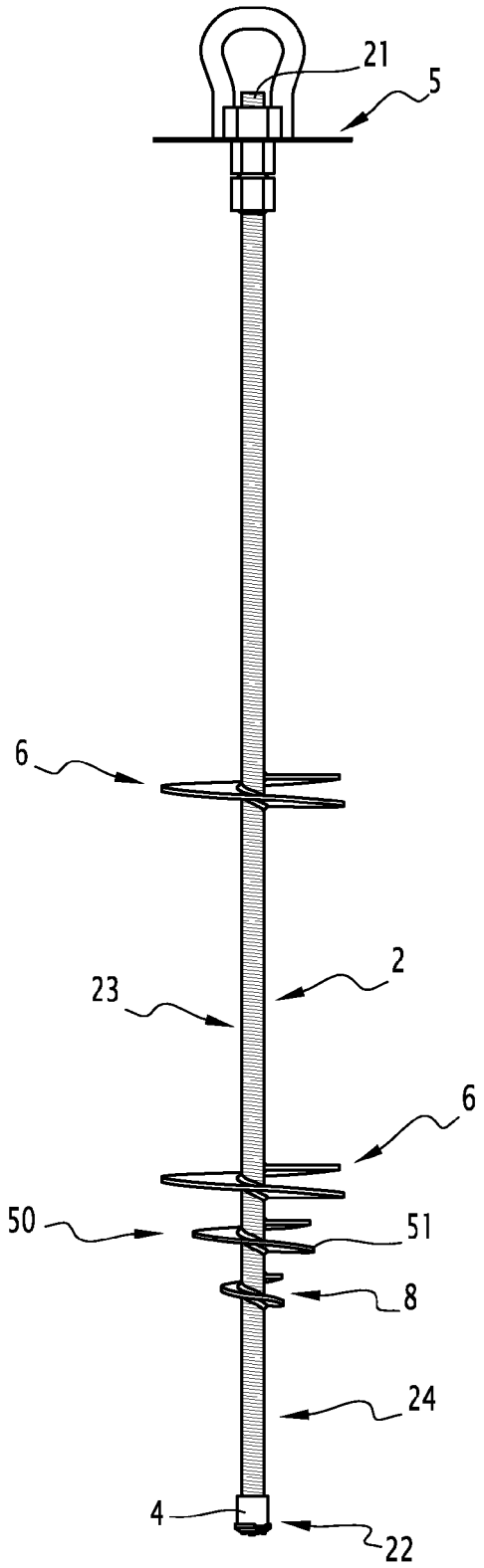
FIG. 6 is a schematic representation of an anchoring device according to a sixth embodiment of the invention.
Figure 7:
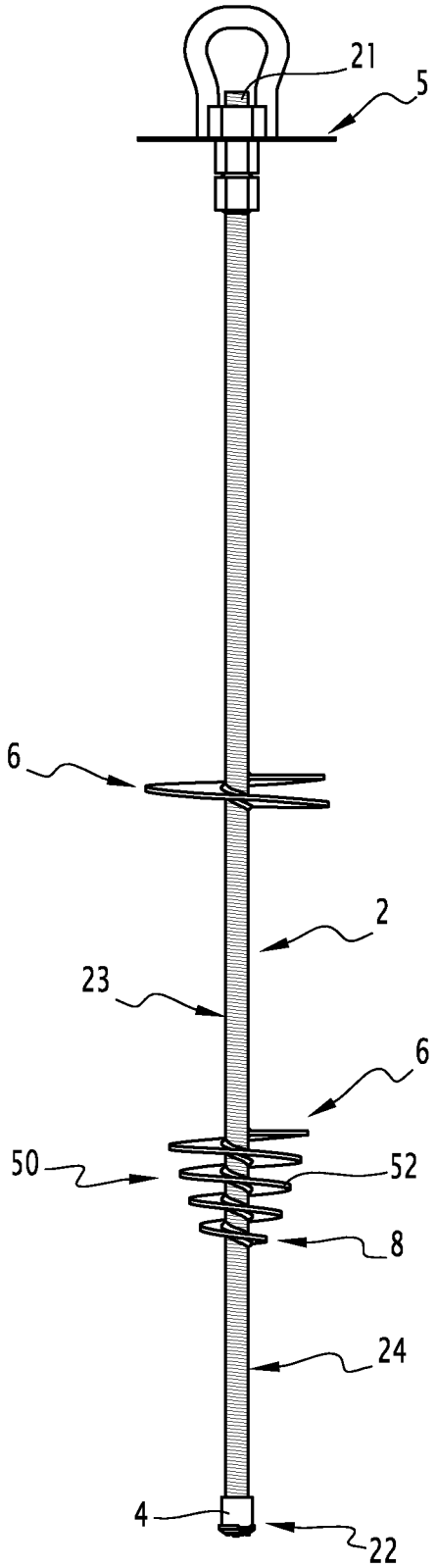
FIG. 7 is a schematic representation of an anchoring device according to a seventh embodiment of the invention.

In FIGS. 6 and 7, the anchoring device is formed by a hollow rod 2, threaded on its entire length between the two ends 21 and 22. The end 22 of the rod 2 is equipped with a bit 4. The helical force disc 6 closest to the bit 4 has an external diameter greater than the external diameter of the helical drilling disc 8.

On its second part 24, between the helical force disc 6 closest to the bit 4 and the helical drilling disc 8, the rod 2 has at least one helical intermediate disc having an external diameter ranging between the external diameters of the helical force disc and drilling disc 8, respectively.

According to the embodiment shown in FIG. 6, the helical intermediate disc consists of at least one interrupted spiral 51 welded to the rod 2.

According to one variant, various interrupted spirals 51 may be included in the space delimited by the helical force disc 6 and the helical drilling disc 8, which interrupted spirals are positioned at variable or constant intervals, and have a diameter within a truncated envelope having a large base that is the diameter of the helical force disc 6 and a small base that is the diameter of the helical drilling disc 8.

According to another embodiment shown in FIG. 7, the helical intermediate disc 50 is formed by a continuous conical spiral 52 connecting the helical force disc 6 and drilling disc 8, respectively. This continuous spiral 52 is within a truncated envelope having a large base determined by the external diameter of the helical force disc 6 and a small base determined by the external diameter of the helical drilling disc 8.

Figure 8:
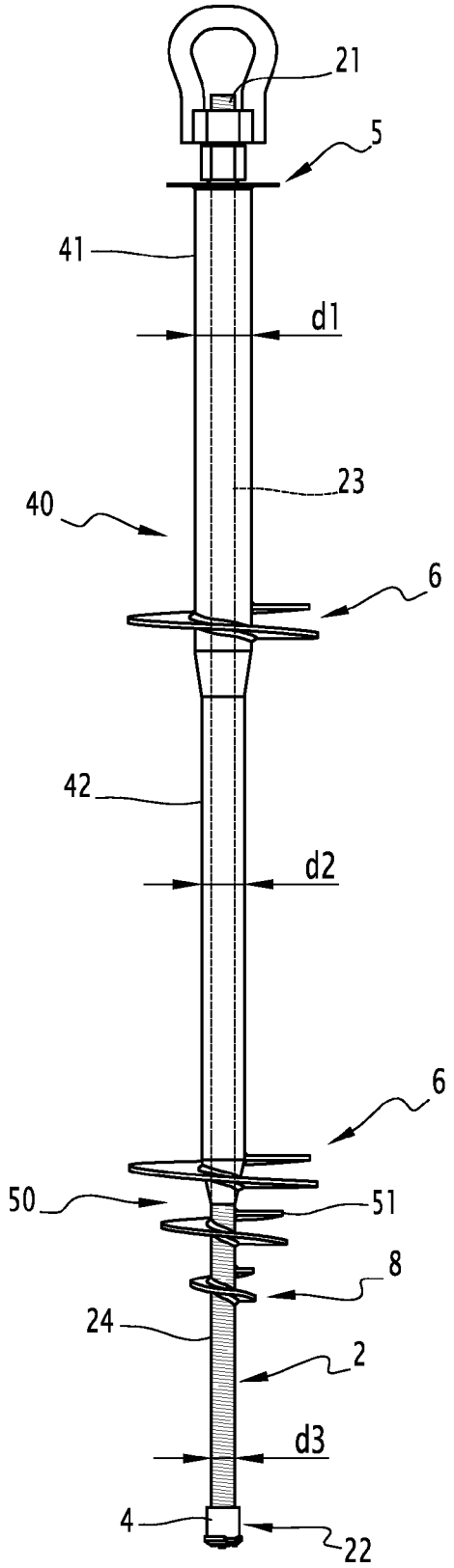
FIG. 8 is a schematic representation of an anchoring device according to an eighth embodiment of the invention.
Figure 9:
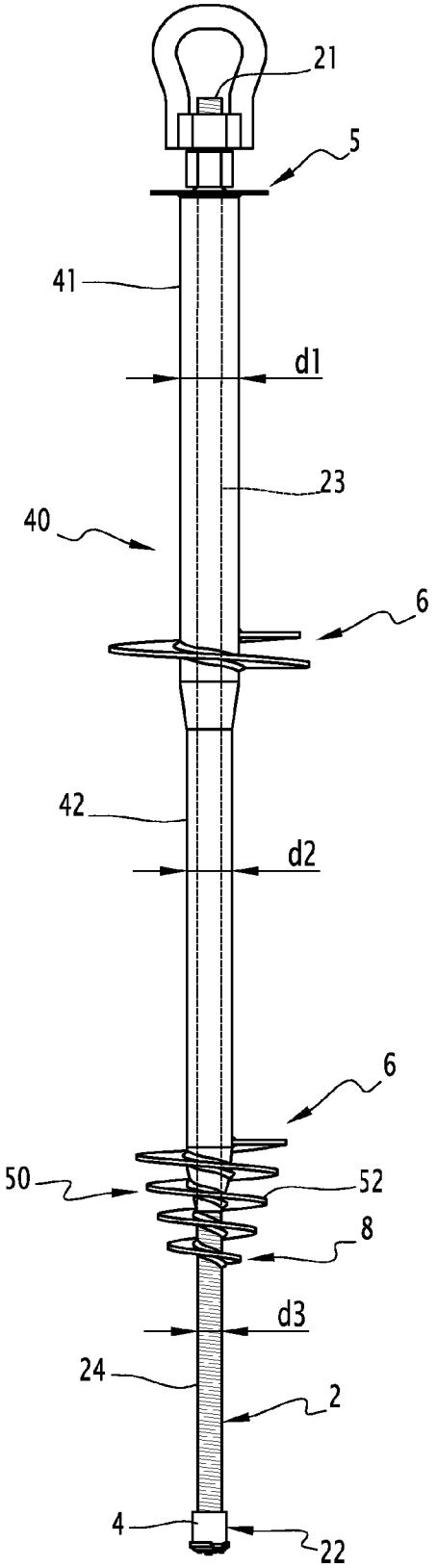
FIG. 9 is a schematic representation of an anchoring device according to a ninth embodiment of the invention.

According to the embodiments shown in FIGS. 8 and 9, a cylindrical casing 40 with a variable diameter and placed around the first part 23 of the rod 2 and the helical force disc 6 closest to the bit 4. This cylindrical casing 40 is identical to that described for the embodiment shown in FIG. 5.

In these embodiments, the helical force disc 6 closest to the bit 4 also has an external diameter greater than the external diameter of the helical drilling disc 8 and the rod 2, and has between this helical force disc 6 and this helical drilling disc 8 at least one helical intermediate disc 50 having an external diameter between the external diameters of the helical force disc 6 and drilling disc 8, respectively.

On FIG. 8, the at least one helical intermediate disc 50 is formed by an interrupted spiral 51 identical to the interrupted spiral of the embodiment shown in FIG. 6. On FIG. 9, the at least one helical intermediate disc is formed by a continuous conical spiral 52 identical to the interrupted spiral of the embodiment shown in FIG. 7.

As shown in the figures, the hollow rod 2 forming the anchoring device has a constant diameter over the entire length of the anchoring device. It will be understood that a rod 2 with a constant diameter allows simplified industrialization of the anchoring device, but could be replaced in one alternative with a variable diameter rod. As one non-limiting example, the diameter of the parts of the rod 2 not covered with a cylindrical casing 20 could be larger than the diameter of the rod surrounded by said casing 20. These diameter variations of the rod must, however, make it possible to produce the aforementioned characteristics, i.e. in particular the bit 4 must have a diameter larger than the diameter of the second part 24 of the rod 2.

Likewise, the figures show a threaded hollow rod 2. It will be understood that this rod can be threaded or smooth, and for example can have a mixed profile. As an example, the rod 2 can be threaded on the second part 24 extending between the drilling disc 8 and the bit 4, and this rod 2 can be smooth in the part 23 surrounded by the cylindrical casing 20.

Such an anchoring device makes it possible to fasten a structure or building in soils having layers with different compositions. The anchoring device is placed by screwing using a roto-striker, supported by a drilling arm or by a submerged installation depending on the considered land or water application. The device can then extend in these different successive layers strictly vertically as shown, or with a different orientation without going beyond the scope of the invention, once the bit and the second part of the rod are anchored in a second monolithic or consolidated soil layer, as illustrated in FIGS. 1 to 3, or loose as illustrated in FIG. 4, and once this second layer is covered with at least a first loose soil layer, and the first part of the rod and the associated discs are screwed into at least the first loose soil layer.

Such a mixed anchoring device, combining the drilling and screwing anchoring features, via a single rod, makes it possible, using a single device, to take all of the anchoring forces into account, i.e. the extraction and bending forces on one hand, and compression and buckling forces on the other.

The mixed anchoring device according to the invention is capable of withstanding various stresses, and primarily bending forces by strengthening the larger diameter of the rod 2. The bending forces are generated by variable forces with an orientation between 0 and 90°.

The invention claimed is:

1. A device for anchoring in multilayer soil having a hollow rod which includes a first end which can receive a fastening means and a free opposite end intended to drill into the ground, in which a positioning plate is mounted on the hollow rod and is intended to bear on the surface of the soil, the rod successively including, from the positioning plate towards the free end, at least one helical force disc then a helical drilling disc, wherein the rod extends beyond the helical drilling disc opposite the positioning plate, and wherein a bit is arranged on the free end of said rod, such that a first part of the rod, suitable for being screwed into at least one first soil layer, extends from the positioning plate to the helical drilling disc, and such that a second part of the rod, suitable for anchoring in a second soil layer, extends from the drilling disc to the bit;

wherein the hollow rod has between the at least one helical force disc and the helical drilling disc at least one helical intermediate disc having an external diameter wherein the external diameter of the at least one helical intermediate disc is between an external diameter of the at least one helical force disc and an external diameter of the helical drilling disc; wherein the multilayer soil includes at least one first soil layer having a thickness of loose material, the first layer resting on a second layer which includes one or more monolithic or consolidated materials; and wherein the bit is a self-drilling bit having rigidity for drilling into the second soil layer;

wherein the at least one helical intermediate disc is formed by a continuous conical spiral, connecting the at least one helical force disc and helical drilling disc, respectively;

wherein a cylindrical casing is formed around the first part of the rod, between the positioning plate and the helical drilling disc; and wherein the hollow rod is threaded over at least the second part extending between the helical drilling disc and the bit, and the hollow rod is smooth in the first part surrounded by the cylindrical casing.

2. The anchoring device according to claim 1, wherein the bit has a diameter larger than a diameter of the second part of the rod.

3. The anchoring device according to claim 1, wherein the at least one helical force disc and the helical drilling disc are welded on the rod.

4. The anchoring device according to claim 1, further comprising a cylindrical casing is formed around the first part of the rod, between the positioning plate and the at least one helical force disc.

5. The anchoring device according to claim 1, wherein the at least one helical intermediate disc is formed by an interrupted spiral.

6. The anchoring device according to claim 1, wherein the cylindrical casing has at least two sections each having a different diameter wherein the smallest diameter is larger than a diameter of the second part of the rod.

7. The anchoring device according to claim 6, wherein the cylindrical casing has a first section extending from the positioning plate and having a first diameter and a second section extending from the first section to the helical drilling disc and having a second diameter smaller than the first diameter and larger than a diameter of the second part of the rod.

8. The anchoring device according to, claim 1, wherein the hollow rod is threaded or smooth.

9. The anchoring device according to claim 1, wherein the external diameter of the at least one helical force disc is greater than the external diameter of the helical drilling disc.

10. The anchoring device according to claim 1, wherein at least part of the rod and the bit are pierced with holes for injecting a cement or a synthetic resin for anchoring in compact rocky-type soils.

11. The anchoring device according to claim 10, wherein the holes for injecting cement are pierced only on the second part of the rod and on the bit.

12. The anchoring device according to claim 10, wherein the holes for injecting cement or resin are pierced over the first part and the second part of the rod and on the bit.

* * * * *